US005778897A

United States Patent [19]

Nordlicht

[11] Patent Number: 5,778,897

[45] Date of Patent: Jul. 14, 1998

[54] SMOKING CESSATION

[76] Inventor: Scott M. Nordlicht, 100 Lake Forest, St. Louis, Mo. 63117

[21] Appl. No.: 597,117

[22] Filed: Feb. 6, 1996

[51] Int. Cl.[6] ..... A24F 47/00

[52] U.S. Cl. ..... 131/279; 221/15

[58] Field of Search ..... 131/270; 221/3, 221/15, 152, 281, 249; 206/249

[56] References Cited

U.S. PATENT DOCUMENTS

| | | | |
|---|---|---|---|
| 4,615,681 | 10/1986 | Schwarz | 131/270 |
| 4,620,555 | 11/1986 | Schwarz | 131/270 |
| 5,203,472 | 4/1993 | Levenbaum et al. | 131/270 |

*Primary Examiner*—Vincent Miller
*Assistant Examiner*—Charles W. Anderson
*Attorney, Agent, or Firm*—Scott M. Nordlicht

[57] ABSTRACT

A smoking cessation method includes the steps of providing a patient with a tamper-resistant, timed release cigarette dispenser, programming the cigarette dispenser to initially release cigarettes from the dispenser one at a time at a first predetermined interval to regularize the smoking habits of the patient, after an initial period, reprogramming the cigarette dispenser to increase the interval at which cigarettes are dispensed to a second predetermined interval which is longer than the first predetermined interval, and continuing to increase the interval at which cigarettes are dispensed by programming the dispenser, until a critical interval is reached. Once the critical interval is reached, the method preferably includes an abrupt cessation of smoking. The time intervals are set by a person other than the patient, and the dispenser is constructed to prevent the patient from programming the time intervals or from obtaining access to the cigarettes therein except at the expiration of the time intervals. A motivating picture such as a family picture may be affixed to the dispenser. The dispensing interval may be adjusted either manually or electronically, and when done electronically may be done remotely. During the treatment emotional and psychological support is preferably provided to the patient on a daily basis.

9 Claims, No Drawings

SMOKING CESSATION

BACKGROUND OF THE INVENTION

This invention relates to devices and methods for enabling a smoker to stop smoking, and more particularly to such devices and methods whose design takes into account both the biological and psychological factors involving in smoking.

Smoking is a complex addiction which occurs on several levels. Initially, there is the tactile aspect. Having a pack of cigarettes in a predetermined place, i.e., in a pocket book, in a shirt pocket, etc., is a feeling which a human being becomes intimately accustomed to, especially over an extended period of time. Then, there is the motor aspect — the reaching motion for a pack of cigarettes, followed by a tapping sensation until a cigarette is freed from the pack. Lighting the cigarette and placing it between ones lips provides another tactile component, in addition to a noise.

Smoking also involves a hyperventilation aspect, breathing tobacco smoke deep into one's lungs, which is clearly a very strong component. With hyperventilation comes relief of anxiety, which explains the calming and anxiety reducing effect of smoking. Once cigarette smoke is inhaled deep within the alveoli of the lungs, nicotine absorption takes place. Nicotine, and the other substances released by inhaled smoke, are separated from the human bloodstream by only a single pulmonary lung cell. An individual's pulmonary capillary abuts against this single lung cell, which interfaces with inhaled smoke on one side and arterial blood on the other, so diffusion of smoke (nicotine) to the blood stream across the lung cell surface takes place. Nicotine et al. gain access to the blood stream and, given the element of chronicity (i.e., cigarette smoking of twenty to forty cigarettes per day, three hundred and sixty five days per year, over ten to fifty years on end), addiction occurs and gains its strength. The "cool look," the rebellious aspects (antiestablishment sentiment—"I know it's bad for my health, but I just don't care"), and other factors (such as the oft repeated quote: "my one true enjoyment in life is a cigarette after a meal") are issues that also bolster the smoking addictive process.

Thus, smoking is a formidable adversary, one whose hold on its victims derives its strength from many sources. It is indeed a true, biological and psychological addiction of the highest sort. The smoking reflex arc involves tactile reinforcement, motor habit, hyperventilation and associated anxiety relief, social reinforcement, as well as true drug addiction, and is continually reinforced, many times a day, every day of the year, for years on end.

Most people would stop smoking if they could, but they simply cannot. There are many reasons for this inability. For most, the habit is simply too deeply entrenched. The drug addiction to nicotine, the constant motor, tactile, and anxiety relief reinforcing aspects, are far too overwhelming for most individuals to overcome. Smokers are caught in a trap: they are confined within a figurative stone wall that for the most part isolates them from their external environment and keeps them continual prisoners in a sense. This wall is too strong for most to scale, since unlike most other addictions, it is an addiction accepted by most in public (it is only recently that smoking in public has become frowned upon). It other words, it is a socially acceptable addiction. For example, you cannot shoot up heroin or smoke marijuana in public, but you can smoke, even in restaurants. Also, many smokers feel they can stop (but say that "it's not time yet"), yet cannot. So in a sense there is an illusion of control that must be overcome as well.

In order to free willing and unwilling smokers from their addiction, the following obstacles and concepts must be recognized and capitalized upon:

1. Most smokers would stop smoking if they could—most are motivated to stop, but they simply cannot by themselves, since they lack the necessary strength and resources to draw upon.
2. Unquestionably nicotine addiction is the strongest primary component behind smoking addiction. Thus, smoking must be recognized for what it truly is—a true drug addition.
3. There are secondary supporting addictions accompanying and reinforcing the smoking habit, whose effect is to make smoking an emotional addiction as well as a tactile addiction, in addition to nicotine addiction.
4. Most smoking addicts are "good people" innocently trapped by the smoking habit. Consider good people caught in a spider web, thrashing and churning all about, without any insight into their predicament, and you have the smoker's dilemma.
5. Most people are too far gone and too weak and dependent to stop smoking on their own, despite whatever they say. This holds true for corporate presidents as well as for juvenile delinquents.
6. Most individuals lack sufficient supporting mechanisms at home to stop of their own accord.
7. Nicotine patches and nicorette gum for the most part will not enable people to stop smoking because only limited limbs of the smoking addiction cycle are addressed. This is why these avenues of approach have met at best with only limited success.
8. Absolute cessation of smoking is too difficult for most smokers to employ as a primary anti-smoking measure, although abrupt abstinence is the most effective way to stop smoking.
9. Women smokers in particular eschew the weight gain that follows smoking cessation and will therefore continue to smoke rather than gain weight. In other words, vanity trumps health.

For all these reasons, currently available smoking cessation methods and devices have met with less than overwhelming success. Examples of currently available devices are shown in U.S. Pat. Nos. 4,615,681 to Schwarz, 4,620,555 to Schwarz, and 5,203,472 to Levenbaum, the disclosures of which are incorporated herein by reference.

SUMMARY OF THE INVENTION

Among the various objects and features of the present invention may the noted the provision of an improved smoking cessation device and system.

Another object is the provision of such a device and system which takes into consideration all of the strengths of the smoking addiction, dealing with all of its reflex arcs involved, and treating all components equally as an addiction of its own.

A third object is the provision of such a device and system which transforms an individual's idiosyncratic smoking world into a constant pattern of cigarette exposure.

A fourth object is the provision of such a device and system which allows the smoker to be gradually weaned from smoking in slow gradual increments until either the pattern is abolished altogether or is decreased substantially. Once a "critical interval" is achieved (which is different for each individual), abrupt cessation of smoking becomes possible.

A fifth object is the provision of such a device and system which enables smokers who cannot achieve total withdrawal to at least significantly reduce their smoking (i.e., a former two pack a day smoker becomes a half a pack a day smoker).

Other objects and features will be in part apparent and in part pointed out hereinafter.

Briefly, in a first aspect of the present invention a smoking cessation method includes the steps of providing a patient with a tamper-resistant, timed release cigarette dispenser, programming the cigarette dispenser to initially release cigarettes from the dispenser one at a time at a first predetermined interval to regularize the smoking habits of the patient, and after an initial period, reprogramming the cigarette dispenser to increase the interval at which cigarettes are dispensed to a second predetermined interval which is longer than the first predetermined interval. In the method one continues to increase the interval at which cigarettes are dispensed by programming the dispenser, until a critical interval is reached, and then abruptly ceases smoking once the critical interval is reached.

In a second aspect of the present invention, a smoking cessation device includes a substantially impenetrable case formed of a suitable material such as steel for containing a day's supply of cigarettes, which case is openable only by an authorized user and has a size similar to that of a pack of cigarettes. The device also includes a settable timer for providing dispense signals at programmable intervals and a dispensing mechanism responsive to the dispense signals for dispensing a single cigarette from the case each time a dispense signal is received. Both manual adjustment and electronic adjustment mechanisms are includes for adjusting the intervals.

DESCRIPTION OF THE PREFERRED EMBODIMENT

Device 11 is preferably about the size of an ordinary cigarette pack. On its front cover it is preferably adapted to accept a photograph 13 of the patient's children, spouse, mother, boyfriend, dog, etc. Device 11 is designed to hold a specified number of cigarettes, equal to the daily consumption of the particular patient using the device.

Device 11 includes two main components: a timing mechanism 15 and a presentation mechanism 17 (FIG. 2). It is preferred that device 11 also include a beeper 18 for audibly signalling to the smoker when a cigarette is available from the device. The timing mechanism can be manually adjusted by an authorized user, but not by the patient, using a manual adjustment mechanism 19. Alternatively, it can be adjusted (again only by an authorized user) using an electronic adjustment mechanism 21. It is preferred that electronic adjustment mechanism 21 be activated by a remotely operated device, such as a conventional pager unit of the type used by physicians. The various components of device 11 are preferably disposed in a secure, lockable case which forms the body of device 11. It is preferred that the interior of the case be made of some material such as steel which cannot be penetrated by prying or hammering, thereby to discourage the patient from cheating. The exterior of the case should be resilient, so as to give device 11 an appropriate feel.

Device 11 is designed for use under professional supervision. An authorized user, at a clinic or a doctor's office for example, will be able to adjust the timing mechanism 15, while the patient will not. Device 11 is set in accordance with a protocol determined by the health care professional. The timing mechanism makes a cigarette available to the patient only at times set by-the health care professional—not by the patient. The patient in this system does not have the ability to control when he or she is going to smoke one of the cigarettes in the device. Significantly, the times when the device presents a cigarette to the patient are at regular intervals, which changes the patient's idiosyncratic smoking pattern into a constant pattern of cigarette exposure.

For example, assume a patient smokes one and a half packs of cigarettes per day and usually sleeps for nine hours. That means the patient is awake for fifteen hours, during which time he smokes thirty cigarettes, or one cigarette every thirty minutes. For this patient, device 11 will contain thirty cigarettes. Every thirty minutes, a compartment 31 will slide open and a cigarette will present itself, which the patient can then smoke. No other opportunity to smoke will be available to the patient (so long as the patient does not cheat and buy cigarettes on the open market as discussed below). To further regularize the patient's pattern of smoking, it is preferred that the device also have an availability timer 33 which sets the maximum interval during which a cigarette is available from device 11. For example, availability timer may be set so that a cigarette is available only for a five minute period every thirty minutes. Timer 33 may be preset, or may be adjusted (directly or remotely) by the health care professional. Similarly, beeper 18 may be activated either internally by device 11 or remotely by the health care professional.

It is further preferred that the case include a button 35 disposed on the exterior thereof which is operatively connected to the presentation mechanism 17. Button 35 is used by the patient to signal the presentation mechanism to present a cigarette. It is effective only during those times when the device has been programmed to dispense a cigarette. For example, when beeper 18 beeps, the patient will have five minutes (or whatever other time is set by the availability timer) to press button 35 to cause the dispensing of a cigarette.

The patient will continue to receive a device 11 containing thirty cigarettes each day from the health care professional until his smoking pattern becomes regularized. Once this regularization of smoking is accomplished, device 11 will be adjusted by the health care professional (using manual adjustment 19 or electronic adjustment 21) to change the schedule of cigarette presentation. For example, the first change could be to make the cigarettes available at forty minute intervals instead of thirty minute intervals. After the patient becomes accustomed to this new interval, device 11 will be further adjusted by the health care professional to increase the presentation interval again (to fifty minutes, for example). This weaning process continues over a significant period such as a year, until either the smoking habit is completely abolished or reduced significantly.

The system of the present invention has the advantages that it is risk free, entails no substitute drug, is totally voluntary, and is driven only by the patient's motivation to stop smoking. All reflex habits are maintained. It employs the same principles as any other form of drug withdrawal routine. Any one could break the process by buying their own pack of cigarettes, but the device 11 itself is substantially impenetrable by the patient. So as long as the patient is motivated, and complies with the program, his smoking pattern will be regularized. From regularization come gradual withdrawal. After gradual withdrawal comes abrupt cessation.

Device 11 is preferably used in connection with a formal clinic to which the smoker reports on a regular basis. The refilling of device 11 will occur solely at the clinic. It is preferred that technical, emotional and psychological support also be provided by the health care professionals at the clinic on a daily basis. They will preferably call the patient daily, to maintain daily support. Dietary input and advice is also preferably an integral component of the overall system, especially for women patients.

Although it is contemplated that device 11 may be used in a program of gradual withdrawal followed by abrupt cessation, it may also be used in other ways. For example, instead of teaching the patient to smoke each cigarette as it is presented, the patient may be taught to take only a few puffs or only half a cigarette at a time, thereby priming the patient for abrupt withdrawal. For those patients for whom complete cessation is not possible, partial withdrawal may become the goal.

The concept behind the present system is that people need help in weaning themselves off cigarettes voluntarily, and that they lack the necessary resources to stop smoking abruptly (or else they would have already). Device 11 allows positive reinforcement (under the auspices of the health care professional), gradual tapering, and then the possibility of abrupt withdrawal once the patient is properly "primed." It relies heavily on the patient's desire to stop smoking, i.e., the wish, the motivation, to end this addiction.

In view of the above, it will be seen that all the objects and features of the present invention are achieved, and other advantageous results obtained. The description of the invention contained herein is illustrative only, and is not intended in a limiting sense.

What is claimed is:

1. A smoking cessation method comprising:

providing a patient with a tamper-resistant, timed release cigarette dispenser;

programming the cigarette dispenser to initially release cigarettes from the dispenser one at a time at a first predetermined interval for a predetermined availability period to regularize the smoking habits of the patient;

after an initial period, reprogramming the cigarette dispenser to increase the interval at which cigarettes are dispensed to a second predetermined interval which is longer than the first predetermined interval;

continuing to increase the interval at which cigarettes are dispensed by programming the dispenser, until a critical interval is reached;

abruptly ceasing smoking once the critical interval is reached.

2. The smoking cessation method as set forth in claim 1 wherein the step of programming the time intervals is performed by a person other than the patient.

3. The smoking cessation method as set forth in claim 2 wherein the dispenser is constructed to prevent the patient from programming the time intervals.

4. The smoking cessation method as set forth in claim 1 wherein the method further includes the step of affixing a motivating picture to the cigarette dispenser.

5. The smoking cessation method as set forth in claim 2 wherein the cigarette dispenser dispensing interval may be adjusted either manually or electronically.

6. The smoking cessation method as set forth in claim 5 wherein the dispensing interval is adjusted electronically and remotely.

7. The smoking cessation method as set forth in claim 2 wherein the dispensing interval is increased over a substantial period of time such as a year.

8. The smoking cessation method as set forth in claim 1 further including providing emotional and psychological support to the patient on a daily basis.

9. The smoking cessation method as set forth in claim 1 wherein the cigarette dispenser may only be refilled by an authorized user, said patient not being an authorized user.

* * * * *